United States Patent [19]

Takagi et al.

[11] 4,063,424

[45] Dec. 20, 1977

[54] DEVICE FOR CONSTRUCTING A FOUNDATION IN SOFT SOIL FORMATIONS

[75] Inventors: Atsushi Takagi, Kanagawa; Hiroyuki Kuroiwa, Tokyo; Masao Miyaguchi, Tokyo; Tateo Kawamura, Tokyo; Yoshihiro Ishikawa, Kanagawa, all of Japan

[73] Assignee: Takenaka Komuten Co., Ltd., Osaka, Japan

[21] Appl. No.: 720,561

[22] Filed: Sept. 7, 1976

[30] Foreign Application Priority Data

Sept. 10, 1975 Japan ..... 50-110282

[51] Int. Cl.[2] ..... E02D 5/36; E02D 5/46

[52] U.S. Cl. ..... 61/63; 61/36 R; 61/50; 61/53.64

[58] Field of Search ..... 61/36 R, 63, 53.52, 61/53.64, 53.66, 50, 56.5, 35; 175/19

[56] References Cited

U.S. PATENT DOCUMENTS

| | | | |
|---|---|---|---|
| 2,048,710 | 7/1936 | Ranney | 61/63 |
| 3,023,585 | 3/1962 | Liver | 61/36 R |
| 3,453,832 | 7/1969 | Rehmar | 61/53.64 |

*Primary Examiner*—Jacob Shapiro

[57] ABSTRACT

The present invention relates to a device for constructing a tubular pile foundation in soft soil formations. Where in use, the device is suspended into the soft soil from a crane or a derrick on the earth or a working barge off shore. The device for stabilizing a body of the soft soil comprises a machine box holding driving means, driving shaft means connected to said drive means, agitating barrel means for stirring the soft soil disposed at the lower end of said driving shaft means, said agitating barrel means having a plurality of agitating blades, and a chemical hardener feeder system for injecting the hardener into the soft soil to form solidified tubular piles, said chemical hardener feeder system including swivel joints, delivery pipes and injection nozzles. The device can be moved upward and downward in course of constructing tubular solid piles in situ by agitating and mixing the soil with the hardener to provide the high bearing capacity to the soil layers.

6 Claims, 5 Drawing Figures

DEVICE FOR CONSTRUCTING A FOUNDATION IN SOFT SOIL FORMATIONS

BACKGROUND OF THE INVENTION

This invention relates to a device for constructing a tubular pile foundation in soft soil fromations brought by deposition of mud, clay, mire, slough, sludge and the like. The deposition may be natural or artificial by wasting industrial sludge. The soft soil has linear compression strength below 1 kg/cm$^2$ in general. Consequently, before earth fill or any structure is loaded on, it is necessary to stabilize the soft soil formations by substituting with firm soils, forming sand drains or solidifing by hardening agent in order to increase the bearing capacity of them.

Among methods for stabilizing the soft soil formations mentioned above, especially in the case of the soil having high water content, it is effective to agitate, mix it with the chemical hardener slurry and then solidify all the agitated cylindrical portion in situ to make a column pile. The bearing capacity of the column pile thus formed is caused mainly by frictional force at its peripheral surface, provided that it does not have any footing at its lowermost end. In other words, the unimportant central portion is also solidified. As a result of it, the area needed to agitate becomes great and then the greater power is required for driving agitating blades. Moreover a lot of the chemical hardener slurry is also required. In addition to the aforementioned drawbacks, the period of the work is rather long since many column piles are formed to cover a desired area worked upon.

OBJECTS OF THE INVENTION

The present invention was developed to eliminate the drawbacks mentioned above, and the general object of the invention is to provide a very effective device for stabilizing the soft soil formations. That is, the most important object is to provide a device which can be used to construct a pile formation in a given area by lesser piles than those of conventional methods.

Another object is to made it possible to stabilize wider area by the use of the same amount of the chemical hardener.

Another object of the invention is to make the period of the work shorter by forming a pile of larger diameter than usual at one operation without using a massive or heavy agitator and without increasing power for driving of agitating blades.

Still another object is to make sure of connection between individual piles by enlarging the diameter of piles to form a wall structure in soft soil formations easily.

BRIEF DESCRIPTION OF DRAWINGS

The appended drawings illustrate embodiments of the present invention.

DESCRIPTION OF THE PREFERRED EMBODIMENT

The embodiment of the present invention will be described below with reference to the drawings.

Figure 1:
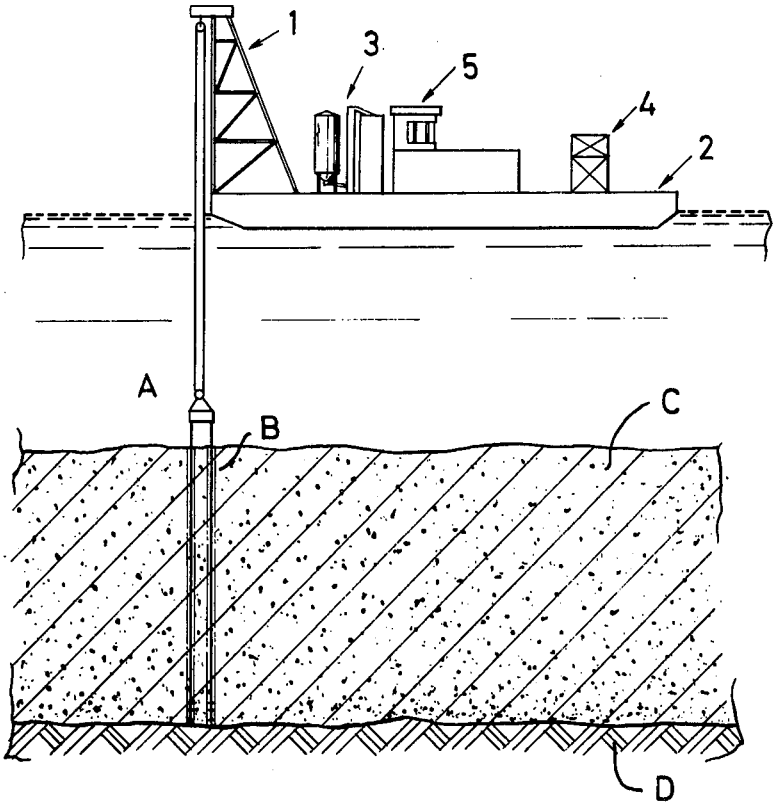
FIG. 1 is a side sectional view showing an agitator according to the invention being used in the site off shore.

FIG. 1 illustrates the off-shore work under construction of a tubular pile foundation B under the water bottom, penetrating a soft soil formation C to the depth of the firm soil or bed rock D in order to provide the soft soil with the bearing capacity. An agitator A according to the present invention is suspended from a derrick 1 on a working barge 2. On the working barge 2 are mounted a chemical hardener plant 3, a driving power generator 4, the derrick 1 used to suspend the agitator A and further a controlling unit 5.

Figure 2:
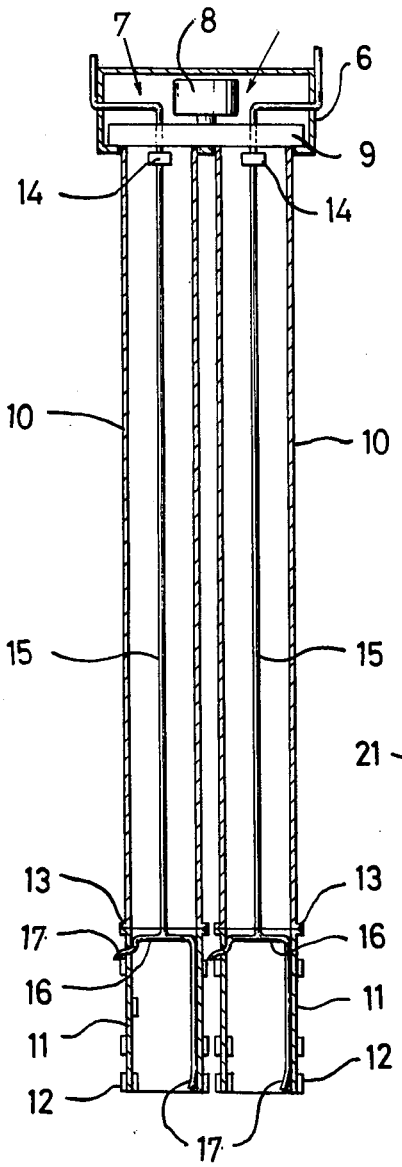
FIG. 2 is a longitudinal section showing an agitator of the first embodiment to the present invention.

FIG. 2 shows an agitator A of the first embodiment according to the present invention. A machine box 6 accepts a driving device 7 including a motor 8 and gear transducers 9. The number of gear reducers 9 corresponds to that of driving shafts 10 rotatably connected thereto depending downwardly and the number of the driving shaft 10 may be selected among one, a pair and some pairs according to the purpose of the work. The driving shaft 10 in this embodiment is shaped as a tube, and is provided at its lower end with an agitating barrel 11 having agitating blades 12 with its both inner and outer faces. The inner blades, however can be omitted if the soil is soft enough to drill without them. As shown in FIG. 2, the barrel 11 is connected by the use of a flange 13 to the tubular shaft 10. The agitating barrel 11 may be formed integrally with a tubular driving shaft 10, but the barrel is more convenient if changeable.

Figure 3:
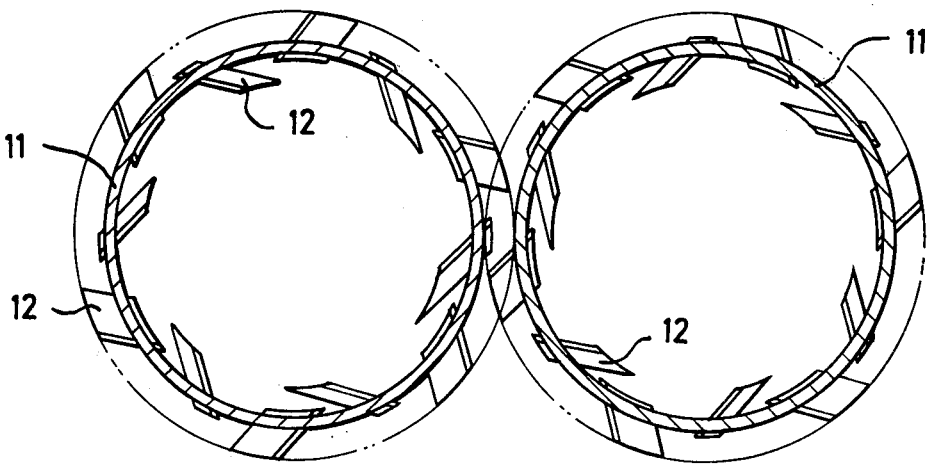
FIG. 3 is a transversal cross-section showing the agitator of the first embodiment according to the present invention.

Each agitating blade 12, as shown in FIG. 3, has its own agitating region in the soil partly common to the other by arranging it with appropriate phase and separation. The total agitated region created by two agitating barrels 11 shown in FIG. 2 is made like 8-shaped. It may be important to suitably select dimensions of the barrel, such as the diameter, length and thickness, and also number, shape and dimentions of the blades arranged on the barrel according to the soil properties and the purpose of the work. The direction of rotation of one of the paired agitating barrels 11 is opposite to that of the other, so that any reaction force caused by the rotation of each agitating shaft may be eliminated on the whole agitator machine. Chemical hardener slurry are prepared at the chemical plant and pumped to a swivel joint 14 fitted to underface of the machine box 6. A delivery pipe 15 for delivering the chemical hardener from the swivel joint 14 is disposed along the center of the tubular driving shaft 10. The swivel joint 14 may be disposed within the tubular driving shaft 10 or above the machine box 6 independently and the pipe 15 may be disposed along the outer and inner face of the driving shaft 7 according to the design of the agitator A. The pipe 15 is spread into two branches 16 at its lower portion and provided with two injection nozzles 17 at each opening end of the branches 16. One of injection nozzles 17 is positioned at the upper portion of the barrel 11 to dischange the hardener outwardly, while the other at the lowermost portion of the barrel 11 to discharge inwardly. The number and the positions of the nozzles may be altered according to the soil properties and the purpose of the work.

Figure 4:
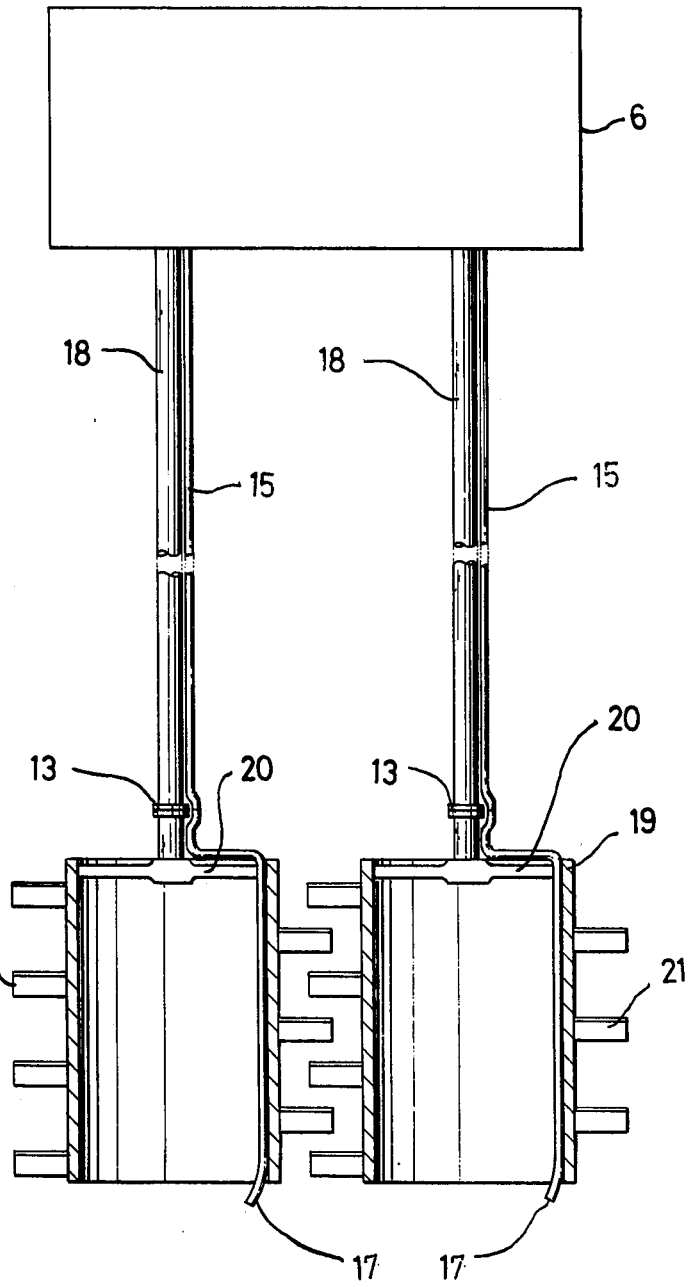
FIG. 4 is a longitudinal cross-section showing an agitator of the second embodiment of the present invention.

FIG. 4 shows an agitator of the second embodiment according to this invention. In this embodiment, the rod-like driving shafts 18 are employed in place of the tubular driving shafts. The driving device 7 including a motor 8 and two gear reducers 9 is equipped in the machine box 6, and rotates two driving shafts 18. The driving shaft 18 is provided at the lower end with an agitating barrel 19. The barrel 19 is connected to the tip end of the shaft by the use of three connecting rods 20 extending radially therefrom. The agitating barrel 19 is provided with agitating blades 21 only on the outer face with appropriate number and arrangement and also injection nozzle at the lower end to discharge the hardener into the soil outwardly.

Figure 5:
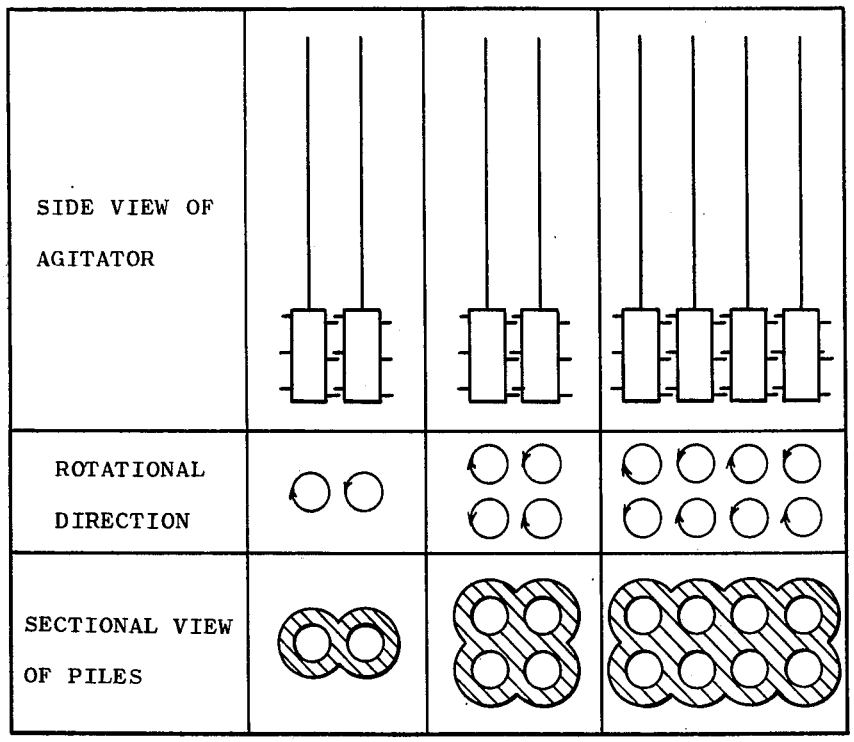
FIG. 5 illustrates schematically the embodiments having at least one pair of shafts, together with the direction of rotation of each shaft and the sectional views of piles formed by the respective agitator.

FIG. 5 illustrates schematically the embodiments having a pair of driving shafts or more together with their directions of rotation and further the sectional views of the silidified piles formed therewith. The total number of the driving shafts included in one agitator unit are desirable to be even, but it may be odd, provided that the machine box 6 to which the driving shafts are connected is fixed to the derrick on the working barge or the like.

As described above, the device for stabilizing the soft soil formations is moved upward and downward through the soft soil, simultaneously rotates the paired driving shafts so as to eliminate the reaction force caused by the shafts rotation. At the same time, the soft soil is agitated, introduced the chemical hardener and mixed together so that the agitated region composes the conjugated tubular sections in order to construct the conjugated tubular piles within the soft soil formations.

According to the present invention, the tubular piles having sufficiently improved sectional performance over the conventional piles are able to be constructed. As a result of it, even though the agitated area is the same, the effective area worked upon becomes even wider. Consequently, it can be realized to reduce the necessary power, to cut the great amount of chemical hardener consumption and further to shorten the term of the work. Moreover it is the another feature of this invention that the present embodiments are easily practicable by only replacing the agitating blade section of the conventional agitator with the agitating barrel as described.

What is claimed is:

1. A device for constructing a tubular pile foundation in soft soil formations comprising:

a machine box in which drive means is accepted;

said drive means including a motor and at least one gear reducer;

driving shaft means connected to said gear reducer;

barrel means disposed at the lower end of said driving shaft means;

a plurality of blades for agitating the soil in annular shape arranged on the inner and outer faces of said agitating barrel means;

swivel joint means disposed beneath said machine box;

pipe means adjacent to and parallel with said driving shaft means for delivering chemical hardener, said pipe means being connected to said swivel joint means and extending to the lower end of said barrel means; and nozzle means formed at the tip end opening of said pipe means for injecting chemical hardener into the soil;

wherein the device is used to construct a tubular pile foundation in the soft soil formations with individual tubular piles or jointed tubular piles each having an annular cross section.

2. A device as claimed in claim 1, wherein said driving shaft means includes a plurality of tubular shafts, each of said tubular shafts having a diameter similar to the diameter of said barrel.

3. A device as claimed in claim 2, wherein said a plurality of tubular shafts consist of at least one pair of them and one of each paired shafts rotates in opposite direction to the other to eliminate reaction forces exerted by each driving shaft on the whole.

4. A device as claimed in claim 1, wherein said driving shaft means includes a plurality of rod-like shafts.

5. A device as claimed in claim 1, wherein said a plurality of rod-like shafts consist of at least one pair of them and one of each paired shafts rotates in opposite direction to the other to eliminate reaction forces exerted by each driving shaft on the whole.

6. A device as claimed in claim 1, further comprising second nozzle means communicating with said pipe means for delivering chemical hardener into the soil adjacent the upper end of said barrel means.

* * * * *